United States Patent [19]

Andersson et al.

[11] Patent Number: 4,699,212

[45] Date of Patent: Oct. 13, 1987

[54] PLATE HEAT EXCHANGER

[75] Inventors: Jarl Andersson; Lennart Edso, both of Lund; Nils-Ake Jonsson, Staffanstorp; Per Rissler, Skanor, all of Sweden

[73] Assignee: Alfa-Laval Thermal AB, Lund, Sweden

[21] Appl. No.: 847,215

[22] Filed: Apr. 2, 1986

Related U.S. Application Data

[63] Continuation-in-part of Ser. No. 582,580 filed as PCT SE83/00249, Jun. 17, 1983, published as WO84/00060, Jan. 5, 1984, abandoned.

[30] Foreign Application Priority Data

Jun. 18, 1982 [SE] Sweden ..... 8203787-0

[51] Int. Cl.[4] ..... F28F 3/08

[52] U.S. Cl. ..... 165/167; 10/27 PH; 16/2; 29/157.3 R; 29/157.4; 29/512; 29/523; 285/158; 285/222

[58] Field of Search ..... 29/512, 523, 157.3 R, 29/157.1 R, 157.4; 16/2; 251/365; 165/166, 167, 162, 134.1; 10/27 PH; 285/158, 222, 162, 382.4

[56] References Cited

U.S. PATENT DOCUMENTS

| | | | |
|---|---|---|---|
| 1,297,142 | 3/1919 | Gibbons | 16/2 |
| 1,871,373 | 8/1932 | Johnson | 10/27 PH |
| 1,978,088 | 10/1934 | Johnson | 10/27 PH |
| 3,200,487 | 8/1965 | Fluke | 29/512 X |
| 3,223,062 | 12/1965 | Mulder | 29/512 UX |
| 3,694,889 | 10/1972 | Pommier | 29/512 X |
| 3,785,029 | 1/1974 | McClellan et al. | 29/157.1 R |
| 4,161,059 | 7/1979 | Francois | 29/512 X |
| 4,482,089 | 11/1984 | Lindahl et al. | 29/157.3 D |

FOREIGN PATENT DOCUMENTS

| | | | |
|---|---|---|---|
| 160180 | 12/1954 | Australia | 10/27 PH |
| 149474 | 11/1980 | Japan | 29/512 |
| 109501 | 6/1925 | Switzerland | 10/27 PH |
| 1285992 | 8/1972 | United Kingdom | 29/512 |

*Primary Examiner*—Charlie T. Moon
*Attorney, Agent, or Firm*—Cyrus S. Hapgood

[57] ABSTRACT

In a plate heat exchanger having a frame plate and a pressure plate, at least one of these plates has holes for flow of the heat exchanging media to and from respective passages in the pack of heat exchange plates. Each of these holes has a lining of corrosion-resistant metal comprising a hollow cylinder with thin flanges at its opposite ends engaging opposite sides of the frame plate or pressure plate. One of these flanges has a seamless connection with the hollow cylinder and is sealingly compressed between a heat exchange plate and an undepressed surface of the inner side of the adjacent frame plate or pressure plate. Lining of the hole is effected by plastically deforming a metal disc into a hollow cylinder with a flange at one end, inserting the other end of the cylinder through the hole to engage the flange with said undepressed surface, and then providing said other end of the cylinder with a flange engaging an undepressed surface of the outer side of the frame or pressure plate.

7 Claims, 6 Drawing Figures

PLATE HEAT EXCHANGER

This application is a continuation-in-part of our copending application Ser. No. 582,580 filed as PCT SE83/00249 on Jun. 17, 1983 published as WO84/00060 on Jan. 5, 1984 now abandoned, and entitled "Lining Fluid Connection Ports in Frame or Pressure Plates of Plate Heat Exchangers". Said copending application describes and claims an invention described and claimed in International Application No PCT/SE83/00249 filed June 17, 1983, claiming priority based upon Swedish application 8203787-0 filed June 18, 1982.

This invention relates to plate heat exchangers and more particularly to a novel arrangement of the parts thereof and a method of assembling the parts.

A plate heat exchanger comprises a number of heat exchanger plates which are fastened between a frame plate and pressure plate. In this connection, a good contact is required between the frame plate and/or the pressure plate and the closest heat exchanger plate.

In the frame plate and/or the pressure plate, inlet holes and outlet holes are made for the heat exchanging media. These media can be corrosive and, therefore, corrode non-alloy steel. However, it is desirable to manufacture the frame plate and/or the pressure plate of a material which is as cheap as possible and which as a rule does not resist corrosive media.

This problem has been solved heretofore by a lining, for instance of metal, inserted into the inlet ports and the outlet ports of the frame plate and/or the pressure plate. The lining is to resist the corrosive medium that goes through the inlet ports and the outlet ports.

When using metal linings the basic material has previously been a cylinder on which has been fastened a flange by welding on each side of the hole of the frame plate and/or the pressure plate. In order to be able to weld the flanges on the cylinder, the thickness of the material ought to be at least 3 mm. As a result, such a metal lining could not be applied directly to the side surface of an unmachined frame plate, because it would have meant that the distance between the frame plate or the pressure plate and the closest heat exchanger plate has become unacceptably large. For this reason, each frame plate and/or pressure plate provided with a metal lining has had to be machined so that a recess for the flanges of the lining is provided at the connection holes on each side of the plate.

Such a machining is both expensive and time-consuming and requires expensive machine equipment. Moreover the welding of the flanges onto the cylinder, which also is both time-consuming and expensive, can introduce unacceptable cracks into the weld so that the lining must be rejected or a new weld must be made. Thus, control measures are an essential feature in connection with the welding procedure, which still more raises the price of the metal linings.

These disadvantages taken together have resulted in conventional metal linings becoming too expensive to manufacture and use.

The heat exchanger of the present invention includes a frame plate and/or a pressure plate in which holes for the heat exchanging media have metallic corrosion-resistant linings adapted for manufacture more cheaply than heretofore and coacting with unmachined surfaces of each plate.

For a better understanding of the invention, reference may be had to the following detailed description in conjunction with the accompanying drawings, in which.

Figure 1:
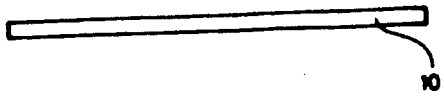
FIG. 1 is an edge view of the basic material used to make the metal lining.

When manufacturing the metal lining, the basic material is a smooth, thin plate 10 (FIG. 1) of a metal more corrosion-resistant than that of the frame and pressure plates. Preferably, the plate 10 is in the form of a round disc with a thickness less than 3 mm, the thickness more preferably being 1 mm or less. This plate is plastically deformed, preferably by deep drawing, pressure rolling and/or pressing, such that a cylindrical pot 20 with edge flange 21 (FIG. 2) is formed. From this pot the bottom is then removed, whereby an open cylinder 30 with an edge flange 31 is formed (FIG. 3).

Figure 4:
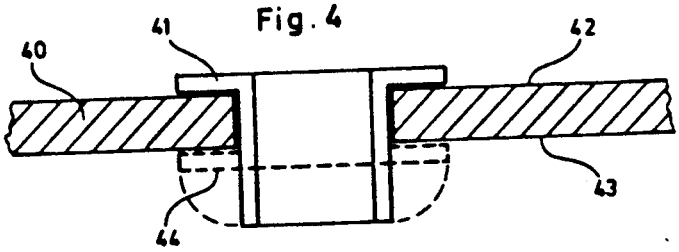
FIG. 4 is a sectional view of a frame plate showing the metal lining inserted in a hole before formation of a second flange, which appears in broken lines.

Before the cylinder is inserted into the frame plate and/or the pressure plate, a heat treatment is made if it is deemed necessary. Then the cylinder is placed in the frame plate and/or the pressure plate 40 with its edge flange 41 towards one side 42 of the plate. In order that the cylinder shall be able to act as an effective lining, a flange ought to be arranged on the cylinder also on the other side 43 of the plate 40. As shown in FIG. 4, this is done by flanging out a part of the cylinder, whereby a flange 44 is formed on the other side 43 of the plate. The flanging is preferably made by pressure rolling and/or pressing.

In the described method the basic material is an uholed plate in the form of a round disc, which has been formed to a cylindrical pot from which the bottom has been removed. It is, however, also possible to start with a holed plate, for instance a round disc provided with a hole. In this case an open cylinder with edge flange is directly formed when deforming the plate.

The described metal lining is provided with flanges that are not fastened by means of welding but have been deformed out of the basic material. Due to that fact the lining can be made of a very thin plate which per se makes the manufacture of the lining cheaper. The most important advantage with the thin lining, however, is that the side walls of the frame plate and the pressure plate do not need to be machined for the flanges of the lining, which as mentioned previously is a very expensive operation. These flanges becomes so thin that they can be put on the outside of the side walls of the frame plate and/or the pressure plate.

The metal lining is preferably designed such that the cylinder section in a plane essentially parallel with the flange/ flanges is circular or elliptic.

Figure 5:
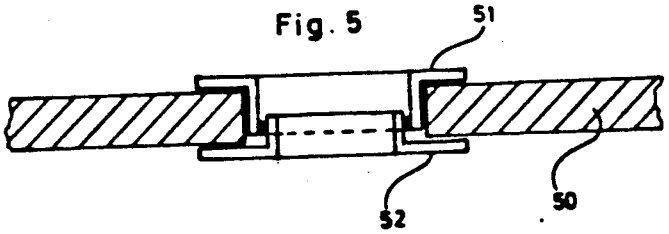
FIG. 5 is a view similar to FIG. 4 but showing an alternative embodiment of the metal lining applied to the frame plate.

In FIG. 5 there is disclosed an alternative embodiment of the invention. In this case the metal lining comprises two parts 51/52 fastened to each other, preferably by means of welding. In this connection each part comprises a cylindrical part with an edge flange resting against a respective side of the frame plate 50.

Figure 2:
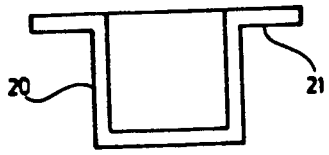
FIGS. 2 and 3 are views of the material after first and second working steps, respectively.
Figure 3:
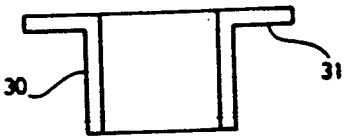

The parts 51, 52 are preferably manufactured by means of deep drawing, pressure rolling and/or pressing of a smooth plate in a similar way as disclosed in FIGS. 1-3.

The advantage with this embodiment is that for given dimensions of the parts 51, 52, the metal lining by moving the parts 51, 52 to or from each other previous to the welding procedure can be used in frame plates and/or pressure plates of different sizes.

As previously mentioned, the frame plates and/or pressure plates of prior plate heat exchangers have required machining side surfaces thereof to provide recesses located at the holes for the heat exchanging media and which receive flanges welded to the ends of the cylinders of prior metal linings. Otherwise, the flanges would result in an unacceptably large distance between the frame plate or pressure plate and the closest heat exchange plate. With the present invention, however, when the plates of the heat exchanger are clamped together in the usual manner, and especially when the metal has the above-mentioned preferred maximum thickness of 1 mm., the flange 41 of each open cylinder or pipe socket 30 can be clamped sealingly between this closest heat exchange plate and an undepressed area of plate 40 shown in FIG. 4.

Figure 6:
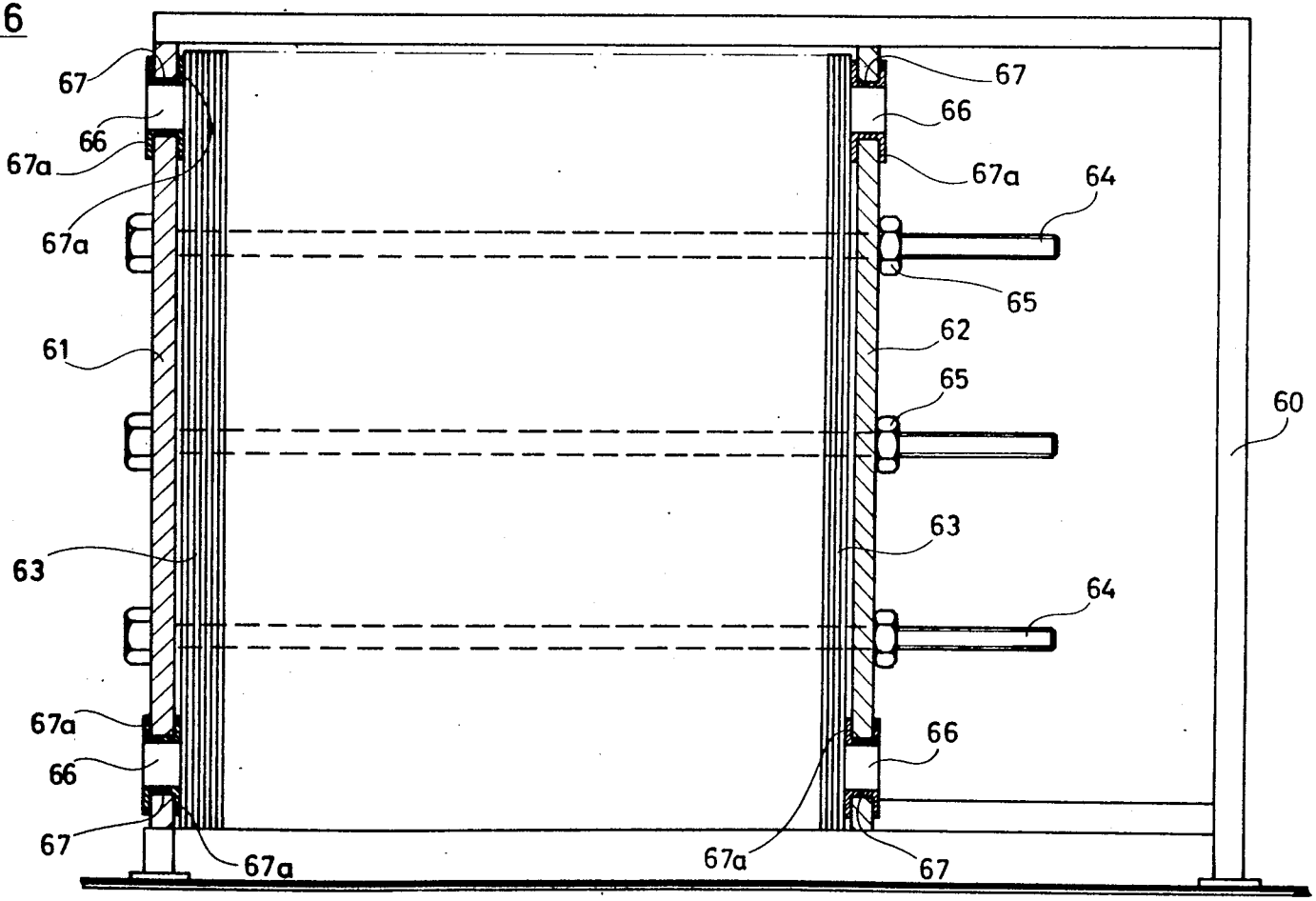
FIG. 6 is a schematic side view, partly in section, of a plate heat exchanger in which holes in the frame and pressure plates are provided with metal linings according to the invention.

This clamping of the plates is illustrated in FIG. 6, where the heat exchanger comprises a frame 60 carrying a frame plate 61 and a pressure plate 62. Between these plates is a pack of heat exchange plates 63, of which only those near the plates 61 and 62 are shown. By conventional means, such as threaded rods 64 and bolts 65, the heat exchange plates 63 are sealingly pressed together between plates 61 and 62. The latter have inlet and outlet holes 66 for conducting the two heat exchanging media to and from their respective passages between adjacent heat exchange plates. Each hole 66 is lined with a metal lining 67 applied as shown in FIG. 4. Thus, the flanges 67*a* at opposite ends of each lining have seamless connections with the hollow cylindrical part of the lining.

It will be understood that the heat exchange plate 63 at each end of the pack is pressed firmly against flanges 67*a* lying against the adjacent plate 61 or 62. Because of the limited thickness of these flanges, as noted above, they not only provide a very thin space between each of plates 61-62 and the adjacent heat exchange plate 63 but also form effective seals against leakage of the heat exchanging media into these spaces.

The heat exchanger of FIG. 6 requires external ducts (not shown) connected to each end plate 61 and 62 for conducting the heat exchanging media to and from the respective passages between plates 63 via metal linings 67. If desired, however, the ducts for this purpose may be connected to only one of the plates 61 and 62 which is provided with all of the metal linings 67, as will be readily understood by those skilled in the art.

We claim:

1. In a plate heat exchanger comprising a frame plate and a pressure plate forming end plates, a pack of heatd exchange plates positioned between said end plates and forming passages for separate flows of two heat exchanging media, at least one of said end plates having holes for conducting said media to and from respective passages in said pack, means for compressing said pack between said end plates, and linings for said holes, said linings being of a metal more corrosion-resistant than said end plates, the improvement wherein each said lining includes a hollow cylinder in a said hole, a first flange having a thickness substantially less than 3 mm., said flange having a seamless connection to one end of the cylinder and being sealingly compressed between an adjacent heat exchange plate and an undepressed surface on one side of a said end plate, which surface surrounds said hole, and a second flange connected to the other end of the cylinder and opposing an undepressed surface on the other side of said end plate.

2. The improvement of claim 1, in which said second flange has a seamless connection to said other end of the cylinder.

3. The improvement of claim 1, in which said second flange has a welded connection of said other end of the cylinder.

4. The improvement of claim 1, 2 or 3 in which said thickness is no greater than 1 mm.

5. The improvement of claim 4, in which at least one heat exchange plate forms with an adjacent end plate a thin intervening space containing a plurality of said first flanges operable to prevent leakage of said heat exchanging media into said space.

6. The improvement of claim 5, in which both of said end plates have holes each provided with a said lining.

7. The improvement of claim 2, in which each said lining is entirely seamless.

* * * * *